United States Patent [19]

Crowley

[11] 4,126,976

[45] Nov. 28, 1978

[54] CONCRETE TANK

[76] Inventor: Francis X. Crowley, 24 Lanark Rd., Wellesley, Mass. 02181

[21] Appl. No.: 863,082

[22] Filed: Dec. 22, 1977

[51] Int. Cl.[2] ..... E04H 7/20; E04H 12/16

[52] U.S. Cl. ..... 52/224; 52/169.7; 52/248; 52/264

[58] Field of Search ..... 52/223–230, 52/247, 248, 169.7, 246, 259, 264, 340, 127, 319, 320, 415

[56] References Cited

U.S. PATENT DOCUMENTS

| | | | |
|---|---|---|---|
| 3,180,057 | 4/1965 | Pritzker | 52/224 X |
| 3,280,525 | 10/1966 | Crowley | 52/224 |
| 3,446,888 | 5/1969 | Crowley | 52/224 X |
| 3,804,260 | 4/1974 | Crowley | 52/224 X |
| 3,822,520 | 7/1974 | Crom | 52/224 |
| 4,015,383 | 4/1977 | Crowley | 52/224 |
| 4,078,354 | 3/1978 | Crowley | 52/224 X |

*Primary Examiner*—J. Karl Bell

[57] ABSTRACT

A prestressed concrete tank comprising a wall of precast concrete panels, cast continuous beams surrounding the wall of panels, the beams including metal prestressing means, and vertically spaced liquid barriers positioned between the inside of the tank and the prestressing means.

13 Claims, 3 Drawing Figures

FIG 1
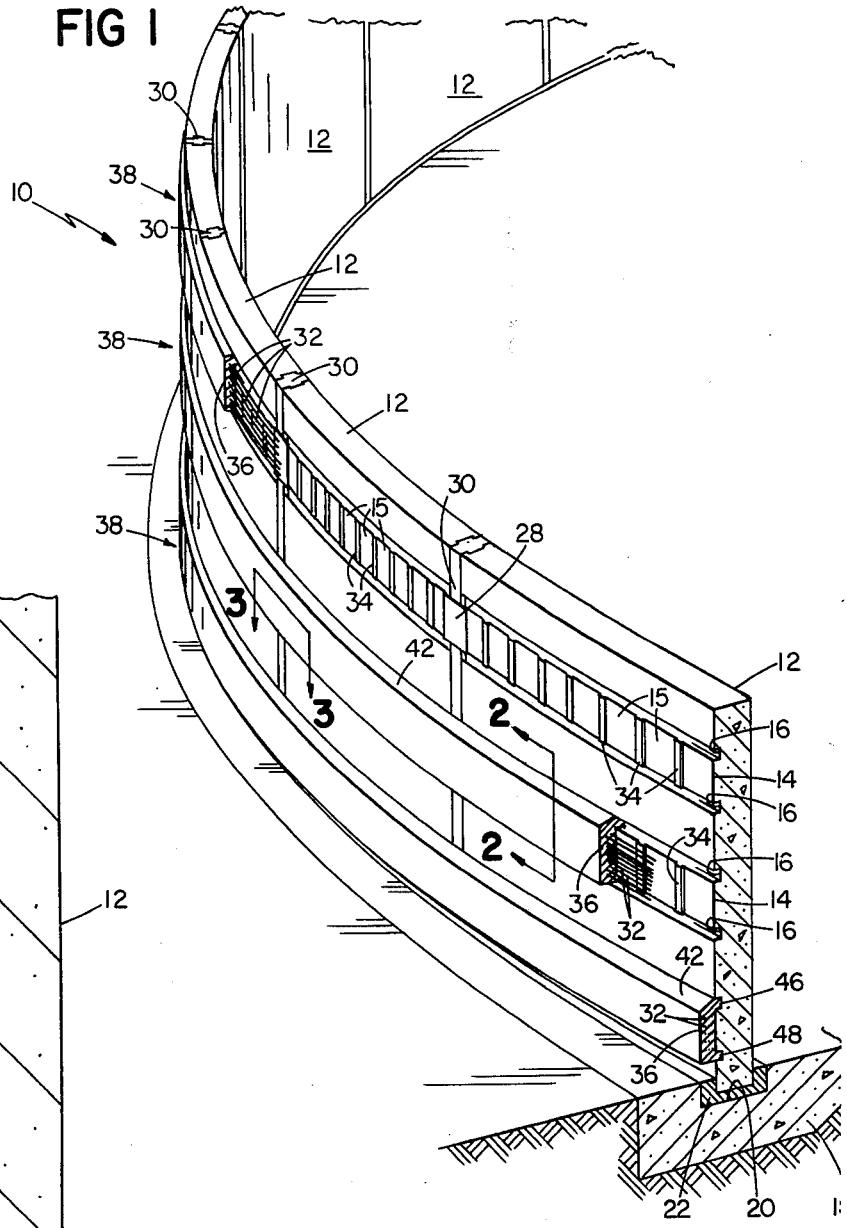
FIG 2
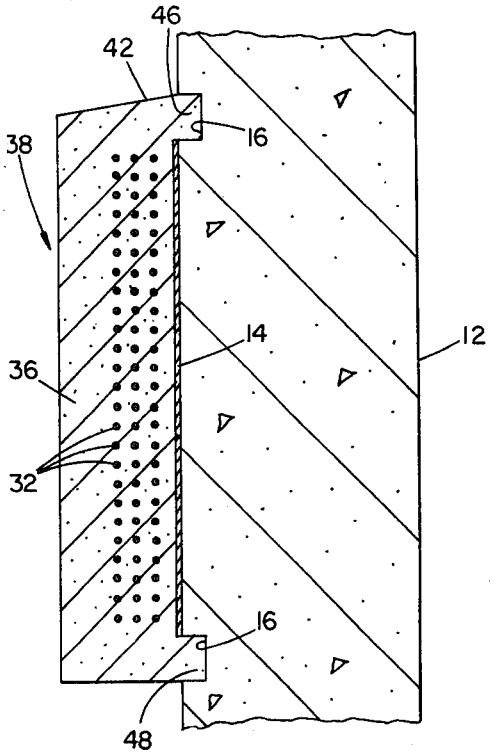
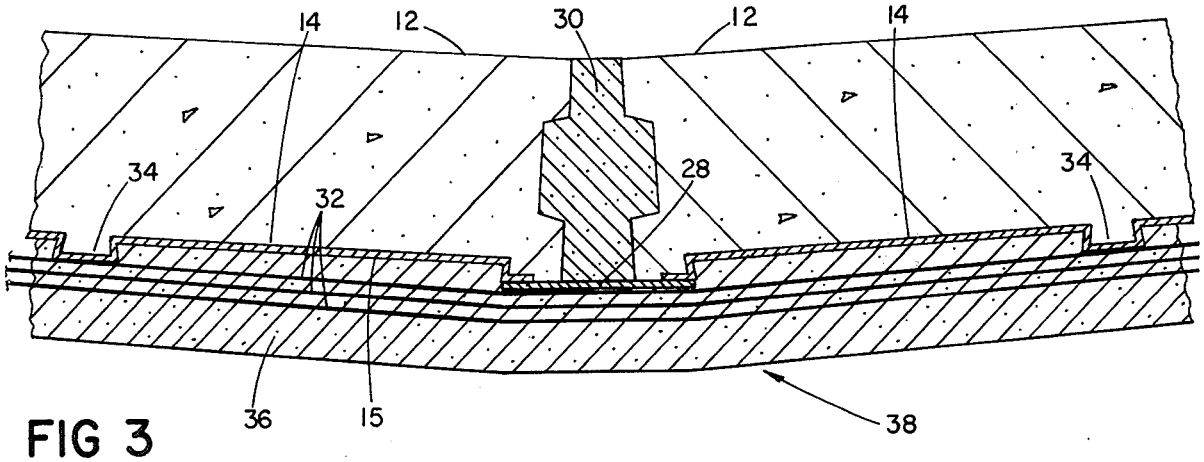
FIG 3

CONCRETE TANK

FIELD OF THE INVENTION

This invention relates to prestressed concrete tanks.

BACKGROUND OF THE INVENTION

It is well known to construct such tanks using precast panels. E.g., in my U.S. Pat. Nos. 3,280,525, and 3,408,784, issued respectively on Oct. 25, 1966, and Nov. 5, 1968, there is disclosed the procedure of precasting concrete panels on sheet metal diaphragms, which serve as molds; erecting the panels, each including its full height diaphragm, on a foundation to form the tank wall; coating the tank wall with pneumatically placed mortar; wrapping steel wire under tension around the coated tank to prestress the wall; and then adding an outer mortar layer to protect the prestressing wire from corrosion.

The diaphragms for such tanks are expensive, specialized machinery is required to fabricate them, and they are subject to damage during shipping. Further, the mortar finishing is also costly, and is especially difficult to apply during severely cold weather.

In my U.S. Pat. No. 4,015,383, issued Apr. 5, 1977, the diaphragms and the mortar finishing are eliminated, and the prestressing wire is encased in vertically spaced concrete beams surrounding the tank wall. But, despite the concrete beams, corrosion of the prestressing wire has been a problem, shortening the life of the tank.

SUMMARY OF THE INVENTION

I have discovered that such corrosion can be retarded by providing vertically spaced liquid barriers positioned between the inside of the tank and the prestressing wire. In preferred embodiments the barriers have circumferentially spaced narrow integral ribs, the prestressing wire bearing against the ribs and being separated from the main barrier wall between the ribs to provide for easier and more complete encasing of the wire during casting of the beams, further protecting the wire against corrosion; each of the beams is provided with a lower reglet to prevent leakage of material during casting; each of the beams is provided with an upper reglet to repel surface water; and the upper surface of each of the beams is beveled downwardly and outwardly for surface water drainage.

My tank is simple to construct with conventionally available equipment and requires little maintenance.

PREFERRED EMBODIMENT

I turn now to the structure and method of construction and operation of the preferred embodiment, first briefly describing the drawings thereof.

Drawings

FIG. 1 is a perspective view, partially in section and broken away, of a portion of a tank embodying the invention.

FIG. 2 is an enlarged section taken along 2—2 of FIG. 1.

FIG. 3 is an enlarged section taken along 3—3 of FIG. 1.

Structure

FIG. 1 shows a portion of a circular tank wall 10 made up of several 12-foot wide concrete panels 12 mounted in annular groove 20 of circular concrete base 18. A seal 22 of cast-in-place mortar or, if desired, a suitable water sealant, is provided. Vertical joints 30 between adjacent panels are formed from cast-in-place mortar. Two-foot high barriers 14, set in the precast panels, are fabricated with a conventional brake press from 26 gauge galvanized steel. The corresponding barriers of adjacent panels are connected across joints 30 by 26 gauge galvanized steel cover plates 28. Each barrier is provided with integral 2-inch wide ribs 34 which are circumferentially spaced on 18-inch centers.

Referring to FIG. 2, each beam 38 is fabricated from $\frac{1}{8}$-inch diameter steel prestressing wire 32 and cast-in-place mortar 36. There is at least a 2-inch cover of mortar 36 over prestressing wire 32 at each external beam face. The top surface 42 of each beam is beveled downwardly and outwardly. Reglets 46 and 48 of each beam are $1\frac{1}{2}$ inches high and extend $\frac{3}{4}$ inch into panels 12.

The size and spacing of beams 38 and the number of layers of prestressing wire 32 for each beam is determined in the conventional way by the size and requirements of the tank. Referring to FIG. 3, ribs 34 are sized to space wire 32 at least $\frac{3}{8}$ inch from the main barrier walls 15. If more than one layer of prestressing wire is required, individual spacer blocks (not shown), such as concrete bricks, are provided between the wire layers. The blocks are sized to space the wire layers by at least $\frac{3}{8}$ inch.

Method of Construction and Operation

Referring to FIG. 1, panels 12 are precast, laying in barriers 14 and forming circumferential grooves 16. Because the barriers are only 2 feet high, they conveniently span a conventionally curved 12-foot wide panel in one piece. Base 18 is prepared with annular groove 20. Panels 12 are erected to form wall 10, a seal 22 being provided in the customary manner.

Panels 12, while being placed on base 18, are arranged with spaces between their adjacent vertical edges. The spaces are then filled with cast-in-place mortar to form joints 30, and cover plates 28 are positioned across the joints and fixed with epoxy to the adjacent barriers.

Steel prestressing wire 32 is wrapped in tension around integral ribs 34 of barriers 14 to prestress the wall by putting it into compression. Suitable form boards are erected, and mortar 36 is cast-in-place about wire 32 continuously around the tank to make beams 38. Mortar 36 is vibrated while being cast to assure that it completely covers wire 32. Lower reglet 48 prevents leakage of the mortar during casting. The top of each beam 38 is mechanically scraped to form a beveled surface 42.

In use, prestressing wire 32 is protected from corrosion not only by mortar 36 but also by barriers 14, which shield the wire from the outward seepage of the stored liquid. Upper reglets 46 prevent surface water from seeping downwardly between the beams and the panels. Surface water is drained from the tops of the beams by beveled surfaces 42.

What is claimed is:

1. A prestressed concrete tank comprising:

a wall of precast concrete panels, a plurality of vertically spaced-apart cast continuous beams surrounding said wall of panels, said beams including metal means for prestressing said wall, and a plurality of vertically spaced-apart liquid barriers corresponding to said vertically spaced-apart beams, each of said barriers being positioned between the inside of said tank and the prestressing means of its corresponding beam.

2. The tank of claim 1 wherein each of said barriers has a height no greater than the height of its corresponding beam.

3. The tank of claim 2 wherein each of said barriers has a height no less than the vertical extent of the prestressing means of its corresponding beam.

4. The tank of claim 3 wherein each of the barriers has a height of 2 feet.

5. The tank of claim 1 wherein said barriers are steel and horizontally span said panels in one piece.

6. The tank of claim 1 wherein each of said barriers is positioned between said panels and the prestressing means of its corresponding beam.

7. The tank of claim 6 wherein said barriers are set in said precast panels.

8. The tank of claim 7 wherein said prestressing means is steel wire, said barriers have circumferentially spaced narrow integral ribs, said wire bearing against the ribs and being separated from the main barrier wall, and said beams comprise mortar cast around said wire.

9. The tank of claim 1 wherein said beams have reglets adjacent their upper ends to prevent surface water from seeping downwardly between said panels and said beams.

10. The tank of claim 1 wherein said beams have reglets adjacent their lower ends to prevent leakage of cast material from said beams.

11. The tank of claim 1 wherein the upper ends of said beams are beveled downwardly and outwardly to drain surface water from said beams.

12. The method of constructing a tank of claim 1, comprising the steps of precasting panels setting in said panels liquid barriers, erecting said precast panels to form the wall of said tank, wrapping metal prestressing means in tension around said tank, casting material around said tensioned prestressing means to form beams.

13. The method of constructing a tank of claim 8, comprising the steps of precasting panels setting in said panels liquid barriers having ribs, erecting said precast panels to form the wall of said tank, wrapping prestressing wire in tension around said tank wall on said ribs, casting mortar around said tensioned wire to form beams.

* * * * *